US006506078B1

(12) United States Patent
Mori et al.

(10) Patent No.: US 6,506,078 B1
(45) Date of Patent: Jan. 14, 2003

(54) EQUIPMENT DIRECT-MOUNTING-TYPE SHIELD ELECTRIC CONNECTOR

(75) Inventors: Shigeo Mori, Shizuoka (JP); Kazuhisa Ishizaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/706,707

(22) Filed: Nov. 7, 2000

(30) Foreign Application Priority Data

Nov. 8, 1999 (JP) ..... 11-316662

(51) Int. Cl.[7] ..... H01R 9/03

(52) U.S. Cl. ..... 439/610; 439/108; 439/752; 439/680

(58) Field of Search ..... 439/610, 752, 439/350, 357, 680, 353, 278, 108, 607

(56) References Cited

U.S. PATENT DOCUMENTS

| | | | | |
|---|---|---|---|---|
| 4,236,779 A | | 12/1980 | Tang | 339/143 R |
| 4,310,211 A | | 1/1982 | Bunnell et al. | 339/91 R |
| 4,402,564 A | * | 9/1983 | Frantz | 439/350 |
| 4,830,629 A | | 5/1989 | Yoshimura | 439/610 |
| 5,108,313 A | * | 4/1992 | Adams | 439/610 |
| 5,167,534 A | * | 12/1992 | Ohsumi | 439/595 |
| 5,803,759 A | * | 9/1998 | Griffith et al. | 439/595 |
| 5,823,824 A | | 10/1998 | Mitamura et al. | 439/585 |
| 6,109,969 A | * | 8/2000 | Kuo et al. | 439/610 |
| 6,152,752 A | * | 11/2000 | Fukuda | 439/752 |

FOREIGN PATENT DOCUMENTS

| | | | |
|---|---|---|---|
| JP | 62-285377 | 12/1987 | H01R/13/658 |
| JP | 7-245153 | 9/1995 | H01R/13/648 |
| JP | 7-282891 | 10/1995 | H01R/13/52 |
| JP | 6-64306 | 3/1996 | H01R/13/648 |
| JP | 8-78098 | 3/1996 | H01R/13/648 |

OTHER PUBLICATIONS

Japanese Abstract No. 07282891 dated Nov. 27, 1995.
Japanese Abstract No. 08064306 dated Mar. 8, 1996.
Japanese Abstract No. 07245153 dated Sep. 19, 1995.

* cited by examiner

*Primary Examiner*—Gary Paumen
*Assistant Examiner*—Felix O. Figueroa
(74) *Attorney, Agent, or Firm*—Sughrue Mion, PLLC

(57) ABSTRACT

A first shield connector (2) includes a first connector housing (11), mounted directly on a mounting portion (13), and a first metal terminal (12) which is inserted into a metal terminal receiving chamber (15) in the first connector housing from a connecting side thereof, and is fixed in the chamber. A second shield connector (4) includes a second connector housing (31), abutted against the first connector housing, a second metal terminal (32), which is inserted into a metal terminal receiving chamber (34) in the second connector housing from that side thereof remote from a connecting side thereof, and is electrically connected to the first metal terminal, and a rear holder (33) which is inserted into the second connector housing from that side thereof remote from the connecting side thereof so as to prevent rearward withdrawal of the second metal terminal, and covers an outer surface of the second connector housing, and is retained on an outer surface of the first connector housing.

6 Claims, 7 Drawing Sheets

EQUIPMENT DIRECT-MOUNTING-TYPE SHIELD ELECTRIC CONNECTOR

BACKGROUND OF THE INVENTION

1. Field of the Invention

The present invention relates to an equipment direct-mounting-type shield electric connector.

The present application is based on Japanese Patent Application No. Hei. 11-316662, which is incorporated herein by reference.

2. Description of the Related Art

There has heretofore been proposed a shield-type electric connector as shown in FIG. 7.

This shield-type electric connector 80 comprises a first shield connector 82 (see, for example, Unexamined Japanese Patent Publication Nos. Hei. 8-78098 and Hei. 8-64306), mounted directly on an equipment (electrical equipment) 81, and a second shield connector 83 (see, for example, Unexamined Japanese Patent Publication Nos. Hei. 7-245153 and Hei. 7-282891) connected to the first shield connector 82.

The first shield connector 82 comprises a first connector housing 84 of a synthetic resin, mounted directly on the equipment 81, and a first metal terminal 85 inserted in the first connector housing 84. The first connector housing 84 has a hood portion 86 for receiving a second (mating) connector housing 90, and a metal terminal receiving chamber 87 for receiving the first metal terminal 85 is formed within the hood portion 86, and extends therethrough. An engagement hole 86*a* is formed through an outer wall of the hood portion 86. An outer peripheral surface of the metal terminal receiving chamber 87 is covered with a first shielding shell 88 made of metal. The first shielding shell 88 is connected to an electrically-conductive contact member 89 provided between the first connector housing 84 and a wall surface 81*a* of the equipment 81.

The second shield connector 83 comprises the second connector housing 90, made of a synthetic resin, a second metal terminal 91, inserted in the second connector housing 90, and a second shielding shell 92 of metal mounted in the second connector housing 90. A metal terminal receiving chamber 93 is formed within the second connector housing 90, and a lock projection 94 is formed on and projects from an outer surface of the second connector housing 90. A conductor 95*a* of a shielded wire (or cable) 95 is electrically connected to the second metal terminal 91. The second metal terminal 91 is inserted in the second shielding shell 92, and a braided wire 95*b* of the shielded wire 95 is secured to a rear end of the second shielding shell 92. The engagement hole 86*a* in the first connector housing 84 and the lock projection 94 on the second connector housing 90 jointly provide a lock mechanism.

When the second shield connector 83 is pushed into the first shield connector 82, the second connector housing 90 is inserted into the hood portion 86 of the first connector housing 84. The first metal terminal 85 is electrically connected to the second metal terminal 91, and the first shielding shell 88 is electrically connected to the second shielding shell 92. The lock projection 94 on the second connector housing 90 is engaged in the engagement hole 86*a* in the first connector housing 84. Namely, the first and second shield connectors 82 and 83 are fitted together. As a result, the external shielded wire 95 is electrically connected to the equipment 81.

However, the second shield connector 83 (including the external shielded wire 95) and the first shield connector 82, mounted directly on the equipment, have many component parts, and therefore there has been encountered a drawback that many electrical contact points are provided when the two shield connectors 82 and 83 are connected together. As a result, the electrical resistance has increased, and the shielding effected has been lowered.

There has been encountered another problem that a pressing force, acting between the first and second shield connectors 82 and 83 during the connecting operation, increases because of an inserting force, acting between the first and second metal terminals 85 and 91, and a frictional resistance force acting between the first and second shielding shells 88 and 92.

And besides, there has been a possibility that the first and second connector housings 84 and 90 are damaged by the pressing force, acting on these housings during the connecting operation, since the two connector housings 84 and 90 are made of an insulative resin. In addition, the lock projection 94 and the engagement hole 86*a* are formed by resin molding, and therefore there has been encountered a disadvantage that molds (not shown) for forming the connector housings 84 and 90 are complicated in construction.

SUMMARY OF THE INVENTION

With the above problems in view, it is an object of the present invention to provide a shield-type electric connector in which the number of component parts is reduced, thereby achieving an enhanced shielding effect, a reduced pressing force during a connecting operation, the prevention of damage to two connector housings during the connecting operation, and a simplified design of molds for resin-molding the two connector housings.

To achieve the above object, according to a first aspect of the present invention, there is provided an equipment direct-mounting-type shield electric connector which includes a pair of first and second shield connectors fittable to each other, wherein the first shield connector includes:

a first connector housing, mounted directly on a mounting portion of an equipment, and a first metal terminal which is inserted into a metal terminal receiving chamber in the first connector housing from a connecting side thereof, and is fixed in the chamber; and wherein the second shield connector includes:

a second connector housing, abutted against the first connector housing, a second metal terminal, which is inserted into a metal terminal receiving chamber in the second connector housing from that side thereof remote from a connecting side thereof, and is electrically connected to the first metal terminal, and a rear holder which is inserted into the second connector housing from that side thereof remote from the connecting side thereof so as to prevent rearward withdrawal of the second metal terminal, and covers an outer surface of the second connector housing, and is retained on an outer surface of the first connector housing.

Accordingly, the first and second shield connectors are simpler in construction as compared with the convention construction. The first and second shield connectors are retained and fixed relative to each other by the rear holder which covers the outer surface of the second connector housing, and serves to prevent the rearward withdrawal of the second metal terminal. With this construction, the first and second connector housings are connected together without the use of the related connector's lock mechanism.

According to a second aspect of the present invention, it is preferable that the first metal terminal is inserted into the metal terminal receiving chamber in the first connector housing from that side thereof remote from the connecting side thereof, and a second rear holder for preventing rearward withdrawal of the first metal terminal is mounted on the first connector housing.

In the second aspect of the present invention, the rear holder for preventing the rearward withdrawal of the first metal terminal is mounted on the first connector housing, and therefore the metal terminal, which is to be inserted into the first connector housing from that side remote from the connecting side, can be used.

According to a third aspect of the present invention, it is preferable that the outer surfaces of the rear holder and the first connector housing are covered with a shielding shell made of metal, and one end of the shielding shell is fixedly secured to the mounting portion made of metal, and the other end of the shielding shell is fixedly connected to a braided wire of a shielded wire connected to the second metal terminal.

In the third aspect of the present invention, the shielding shell, made of metal, covers the outer surfaces of the rear holder and the first connector housing, and the one end of the shielding shell is fixedly secured to the mounting portion on which the first connector housing is directly mounted, and the other end of the shielding shell is fixedly connected to the braided wire of the shielded wire connected to the second metal terminal. Therefore, the braided wire of the shielded wire is connected to the mounting portion through the shielding shell.

According to a fourth aspect of the present invention, it is preferable that the one end of the shielding shell is fixedly secured to the mounting portion, and the shielding shell has a slanting wall formed intermediate the opposite ends thereof, and the slanting wall urges that side of the rear holder, remote from the connecting side thereof, toward the connecting side thereof.

In the fourth aspect of the present invention, the shielding shell has the slanting wall formed intermediate the opposite ends thereof, and therefore after the one end of the shielding shell is fixedly secured to the mounting portion, the slanting wall urges that side of the rear holder, remote from the connecting side thereof, toward the connecting side thereof, so that the connected condition of the first and second connector housings is maintained.

BRIEF DESCRIPTION OF THE DRAWINGS

FIG. 4A is a front-elevational view, and FIG. 4B is a side-elevational view;

DETAILED DESCRIPTION OF THE PREFERRED EMBODIMENT

A preferred embodiment of the present invention will now be described with reference to FIGS. 1 to 6. FIGS. 1 to 6 show one preferred embodiment of a shield-type electric connector of the present invention.

Figure 1:
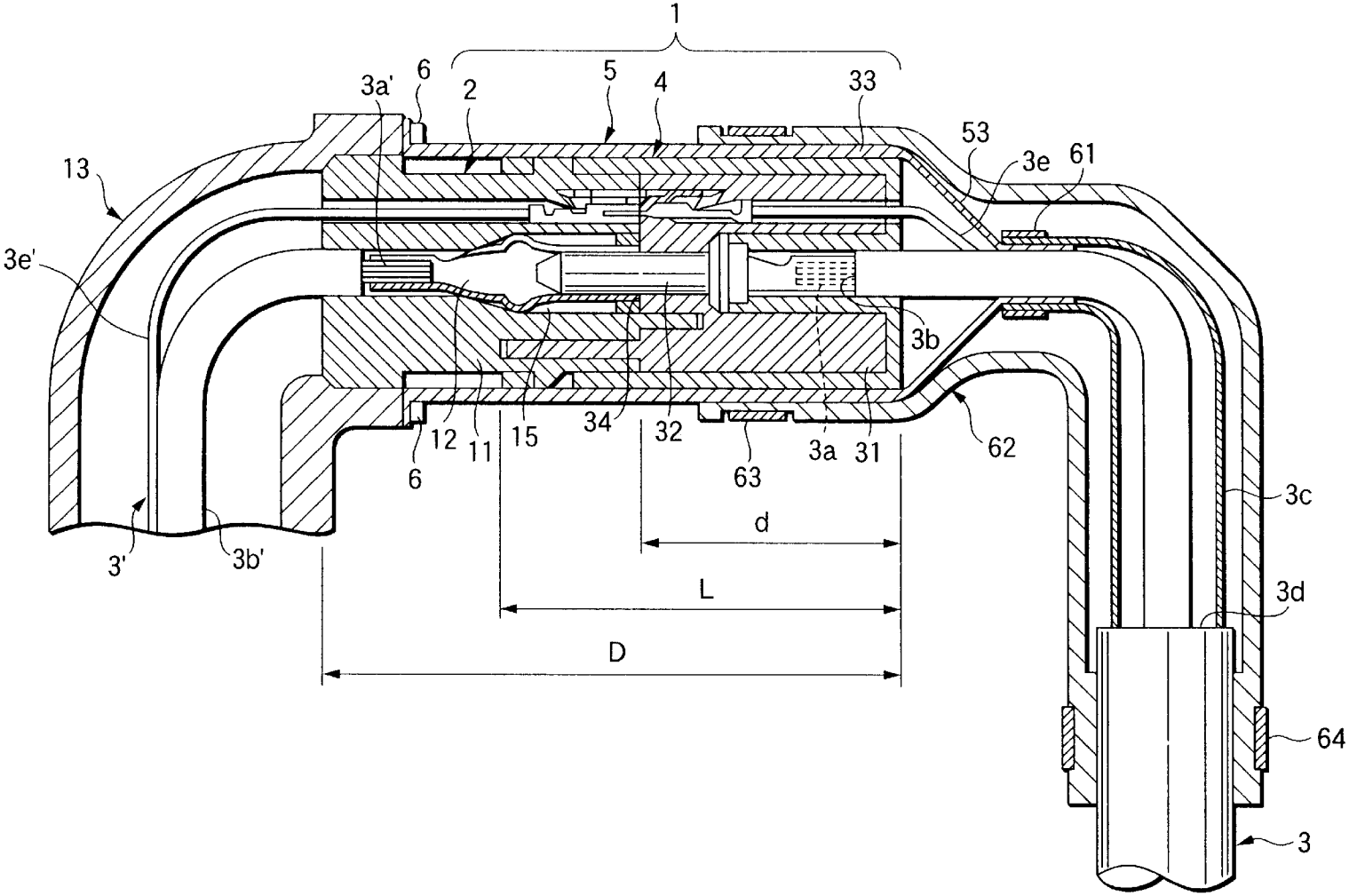
FIG. 1 is a view showing one preferred embodiment of an equipment direct-mounting-type shield electric connector of the present invention.

As shown in FIG. 1, this shield-type electric connector 1 comprises a first shield connector 2, mounted directly on an equipment (not shown), a second connector 4, electrically connected to an external shielded wire (or cable) 3, and a shielding shell 5 connecting and holding the two shield connectors 2 and 4 together.

The shielded wire 3 comprises an electrically-conductive conductor 3*a*, disposed at the center thereof, an insulator 3*b*, covering an outer surface of the conductor 3*a*, a braided wire 3*c*, covering an outer surface of the insulator 3*b* in enclosing relation thereto, and a sheath 3*d* formed on an outer surface of the braided wire 3*c*.

Figure 2:
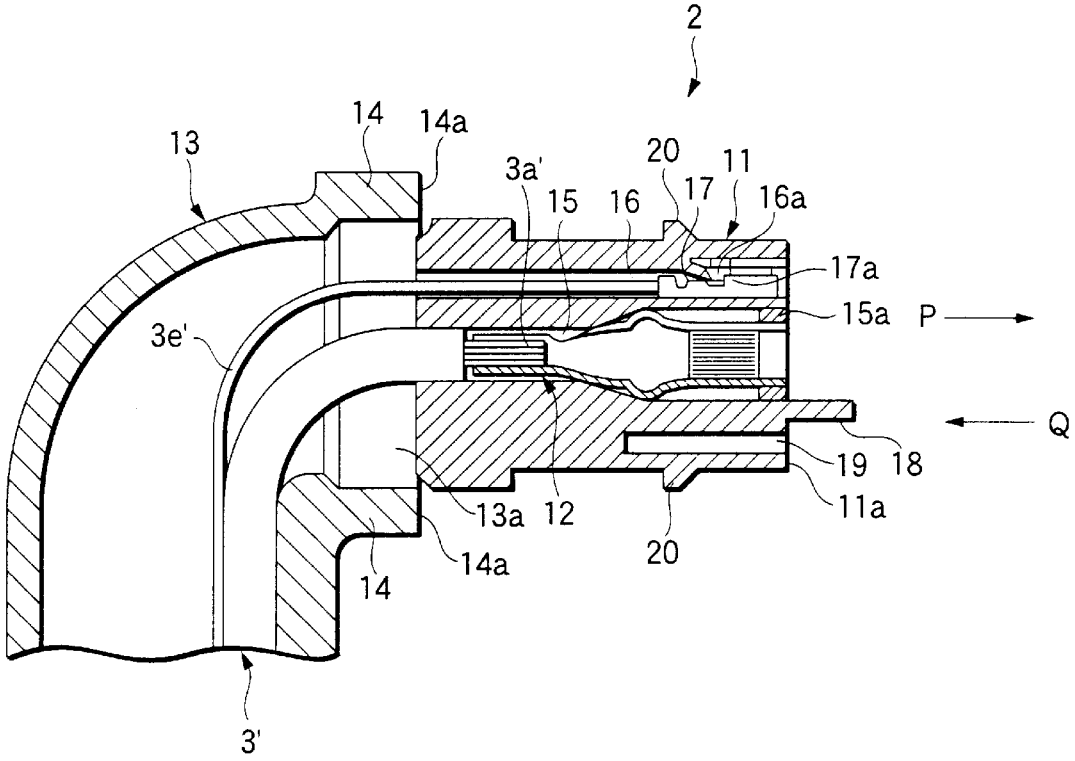
FIG. 2 is a view showing a first shield connector in FIG. 1.

As shown in FIGS. 1 and 2, the first shield connector 2 comprises a first connector housing 11 of a synthetic resin, mounted directly on the equipment, and a first metal terminal 12 mounted within the first connector housing 11.

The equipment is provided with a mounting portion 13 through which a wire 3' is passed. An engagement peripheral flange 14 is formed on and projects from an outer surface of the mounting portion 13 at an open end 13*a* thereof. A plurality of fastening holes 14*a* are formed in the flange 14. One end of the first connector housing 11 is the connecting side (front end), and the other end portion of the first connector housing 11 is fitted into the open end 13*a* of the mounting portion 13. A metal terminal receiving chamber 15 and a terminal receiving chamber 16 are formed in the first connector housing 11 in parallel relation to each other. The first metal terminal 12 for a large electric current is press-fitted into the metal terminal receiving chamber 15 from the front side, and is fixed in this chamber. The metal terminal receiving chamber 15 is tapering toward the rear side, and therefore prevents the first metal terminal 12 from rearward withdrawal therefrom without the use of a rear holder. A conductor 3*a'* of the wire 3' is secured to the first metal terminal 12 by pressing (or by press-fitting). On the other hand, a terminal 17 for a signal is retained in the terminal receiving chamber 16. An elastic retaining lance 16*a* for retaining the terminal 17 is formed integrally on an inner surface of the terminal receiving chamber 16. A signal wire 3*e'* is connected to the terminal 17.

A positioning pin 18 is formed integrally on and projects forwardly (in a direction P) from the connecting side (front end) of the first connector housing 11, this pin 18 being disposed below the metal terminal receiving chamber 15. A pin receiving hole 19 is formed in the connecting side (front end) of the first connector housing 11, and extends rearwardly (in a direction Q), this hole 19 being disposed below the positioning pin 18.

A plurality of engagement projections 20 are formed integrally on the outer surface of the first connector housing 11 at equal intervals.

Figure 3:
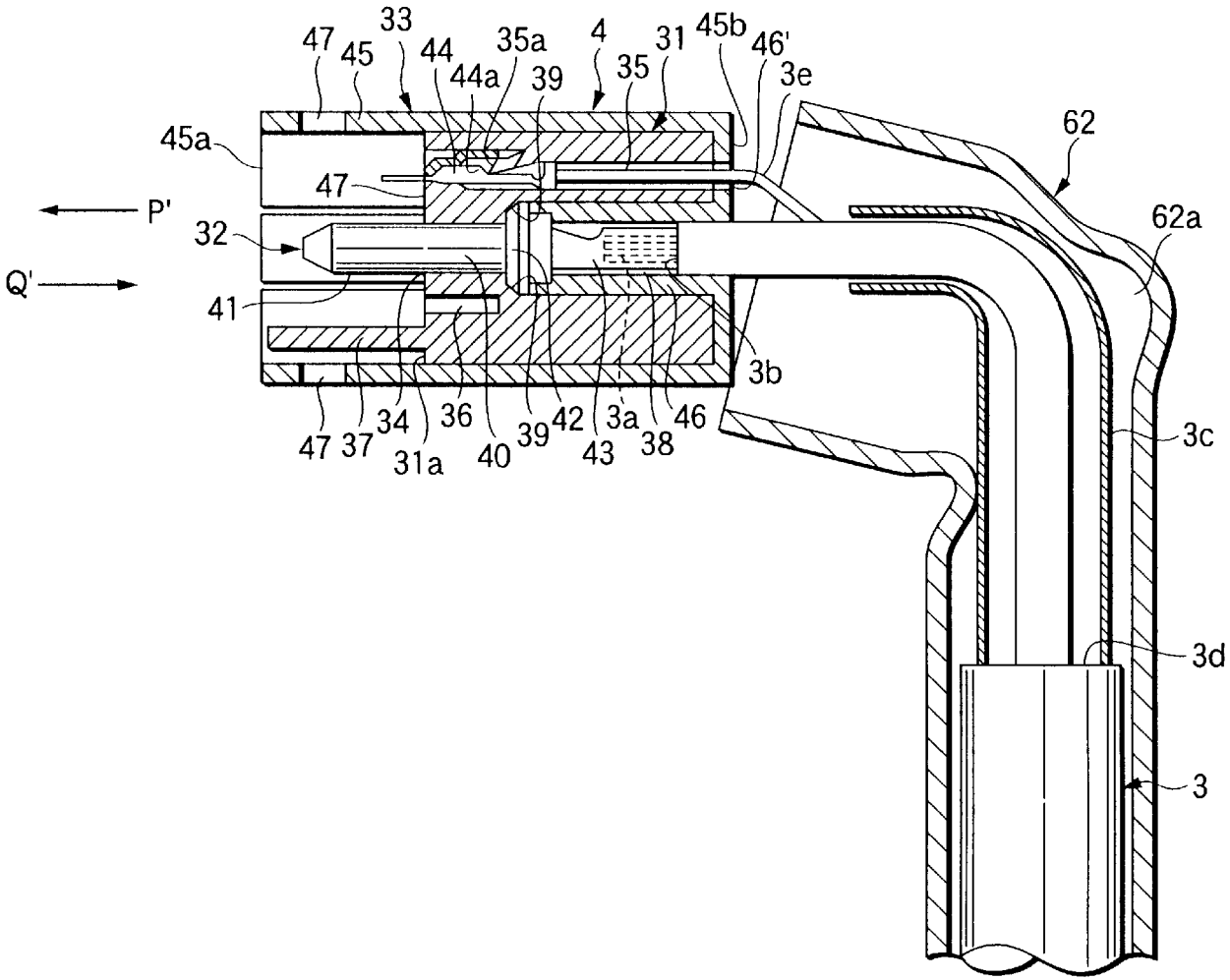
FIG. 3 is a view showing a second shield connector in FIG. 1.

As shown in FIGS. 1 and 3, the second shield connector 4 comprises a second connector housing 31, made of an insulative synthetic resin, a second metal terminal 32, mounted within the second connector housing 31, and a rear holder 33 of an insulative synthetic resin for holding the second metal terminal 32.

A metal terminal receiving chamber 34 and a terminal receiving chamber 35 are formed in the second connector housing 31. A pin receiving hole 36 is formed in the second connector housing 31, and extends rearwardly (in a direction Q'), this hole 36 being disposed below the metal terminal receiving chamber 34. A positioning pin 37 is formed integrally on and projects forwardly (in a direction P') from the second connector housing 31, this pin 37 being disposed below the pin receiving hole 36. The second metal terminal 32 for a large electric current is inserted in the metal terminal receiving chamber 34. The conductor 3*a* of the shielded wire 3 is connected to the second metal terminal 32 (by pressing or by press-fitting).

The second metal terminal 32 includes an electrically-conductive tubular terminal body 40, a spring member 41, mounted on a front end portion of the terminal body 40, an engagement flange 42 formed on the terminal body 40 intermediate the opposite ends thereof, and a conductor clamping portion 43 formed at a rear end portion of the terminal body 40.

A terminal 44 is inserted in the terminal receiving chamber 35. A signal wire 3*e*, extending from the shielded wire 3, is secured to the terminal 44 by pressing (or by press-fitting). A retaining lance 35*a* for engagement with a shoulder 44*a* of the terminal 44 is formed integrally on an inner surface of the terminal receiving chamber 35.

A pair of pressing tube-receiving chambers 38 of a larger diameter are formed in that portion of the metal terminal receiving chamber 34 disposed at the rear portion of the second connector housing 31 remote from the connecting side (front end) thereof. An engagement step portion 39 is formed between the terminal receiving chamber 34 and the pressing-tube receiving chamber 38.

Figure 4B:
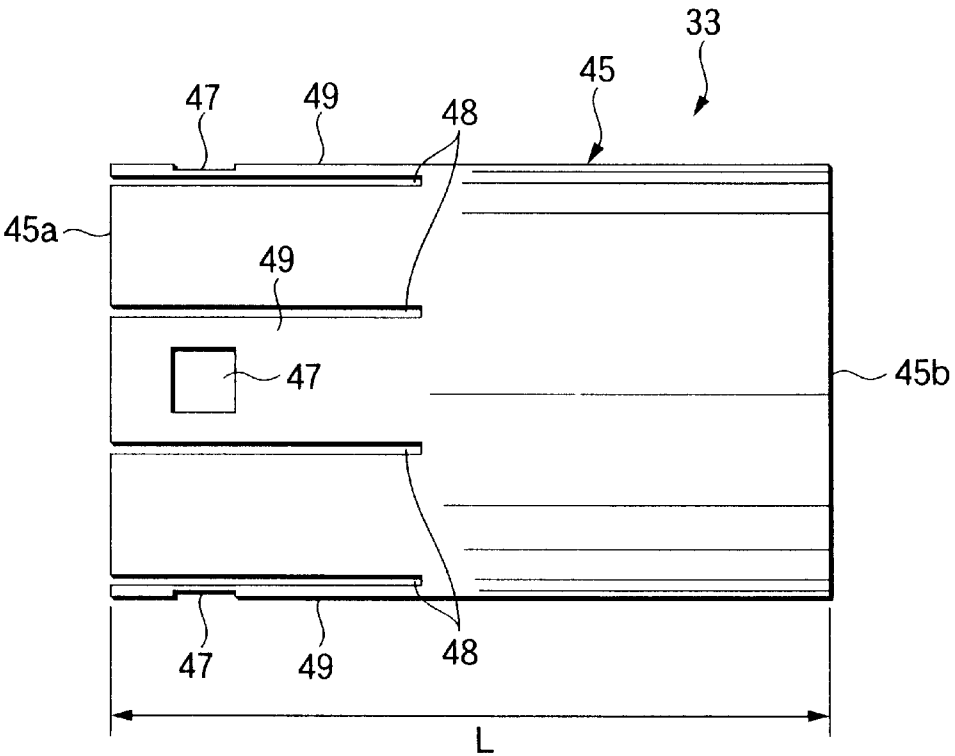
FIGS. 4A and 4B show a rear holder in FIG. 3.
Figure 4A:
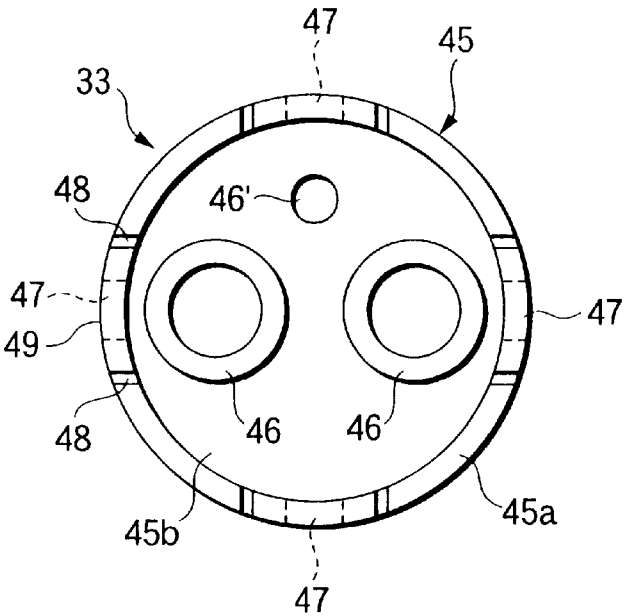

As shown in FIGS. 3 and 4, the rear holder 33 includes a tubular holder body 45, having an open end (one end) 45*a*and a closed end (the other end) 45*b*, a pair of terminal pressing tubes 46 and 46, extending from the closed end 45*b* into the interior of the holder body 45 toward the one end thereof, and engagement holes 47 formed through a peripheral wall of the holder body 45. The terminal pressing tubes 46 are received in the pressing tube-receiving chambers 38, respectively, so that the engagement flange 42 of the second metal terminal 32 is held against the engagement step portion 39.

A pair of slits 48 are formed through each of upper, lower, right side and left side portions of the peripheral wall of the holder body 45, so that four elastic engagement walls 49 are provided. The engagement holes 47 are formed through the four elastic engagement walls 49, respectively. A signal wire hole 46' is formed through an upper portion of the closed end 45*b* of the holder body 45. The signal wire 3*e* is passed through the signal wire hole 46'.

As shown in FIGS. 1 and 4B, the length L (longitudinal length) of the holder body 45 from the one end to the other end is larger than the length d of the second connector housing 31 from the rear end to the front end, and is smaller than the combined lengths D of the first and second connector housings 11 and 31 ($d<L<D$).

Figure 5:
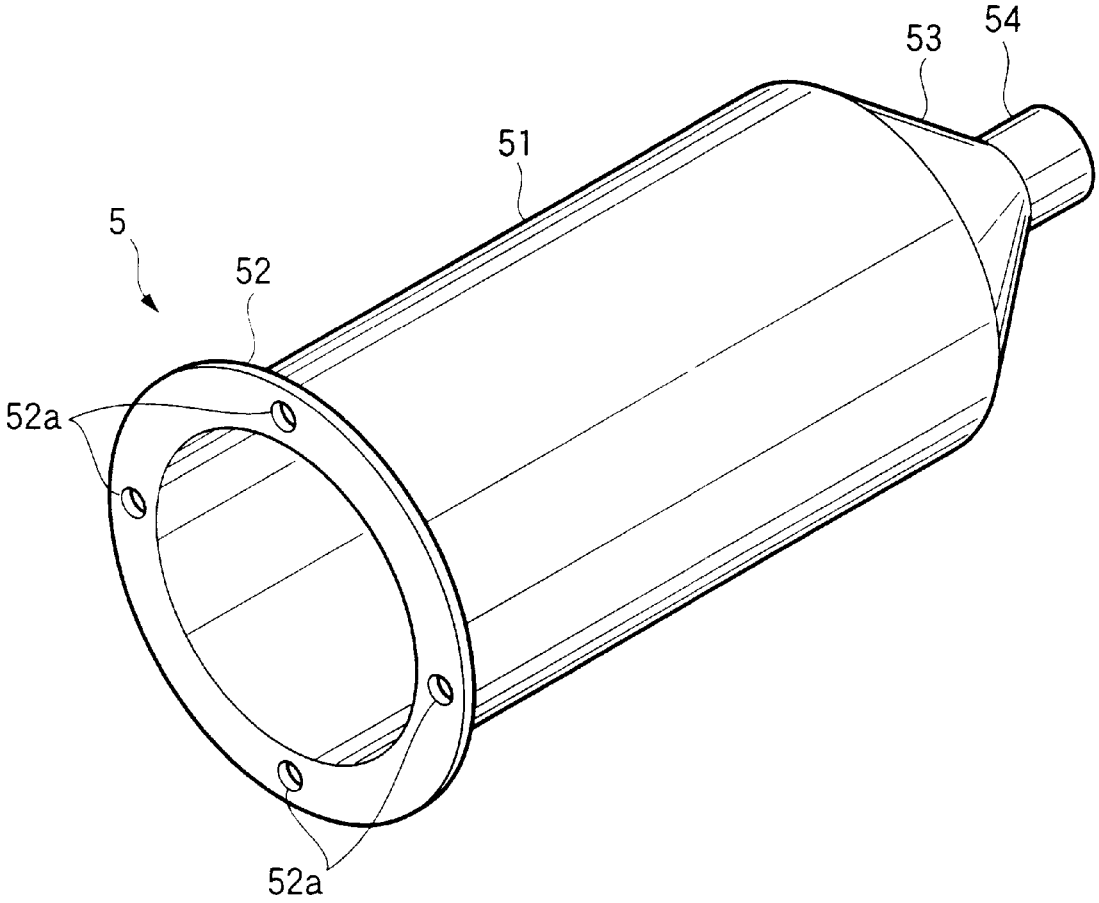
FIG. 5 is a perspective view of a shielding shell in FIG. 1.

As shown in FIGS. 1, 3 and 5, the connected condition of the first and second shield connectors 2 and 4 is maintained by the shielding shell 5 made of metal.

The shielding shell 5 includes a cylindrical shell body 51, a mounting flange 52, formed integrally at one end of the shell body 51, a funnel-like slanting (tapering) wall 53, extending from the other end of the shell body 51, and a braided wire-connecting tube 54 of a smaller diameter formed integrally at a reduced-diameter end of the slanting wall 53.

The shell body 51 is designed to cover the outer surface of the rear holder 33. The diameter of the shell body 51 is larger than the diameter of the rear holder 33. The mounting flange 52 extends outwardly from the outer surface of the shell body 51. Fixing holes 52*a* are formed through the mounting flange 52. The fixing holes 52*a* are to be aligned respectively with the fastening holes 14*a* formed in the engagement flange 14 on the mounting portion 13. The mounting flange 52 is abutted against the engagement flange 14, and is fixedly secured thereto by bolts (or screws) 6. The larger-diameter end of the slanting wall 33 is slightly smaller in diameter than the rear holder 33. By fixedly securing the mounting flange 52 to the engagement flange 14, the shielding shell 5, covering the rear holder 33, holds and fixes the first and second shield connectors 2 and 4.

At this time, the slanting wall 53 is in an expanded condition (that is, enlarged in diameter), and therefore the shielding shell 5 urges the rear end of the rear holder 33 toward the first shield connector 2. Namely, the first and second shield connectors 2 and 4 can be held by the shielding shell 5 through the rear holder 33.

As shown in FIGS. 3 and 5, the reduced-diameter end is smoothly continuous with the braided wire-connecting tube 54. The inner diameter of the braided wire-connecting tube 54 is generally equal to the outer diameter of the insulator 3*b* of the shielded wire 3.

As shown in FIGS. 1 and 3, the braided wire 3*c* of the shielded wire 3 is mechanically held between the braid wire-connecting tube 54 and a shielding tube 61 of metal, and also is electrically connected thereto. More specifically, the braided wire 3*c* is held between the braided wire-connecting tube 54 and the shielding tube 61, and thereafter the braided wire-connecting tube 54 and the shielding tube 61 are compressed or deformed by a press or the like (not shown) to hold the braided wire 3*c* therebetween.

The mounting portion 13, the engagement flange 14 and the shielding shell 5 are all made of metal, and therefore the braided wire 3*c* in the second shield connector 4 is electrically connected to the mounting portion 13 through the shielding shell 5 and the engagement flange 14. With this construction, the number of electrical contact points is smaller as compared with the conventional construction. Therefore, the shielding effect can be enhanced.

A rubber grommet 62 is fitted on the shielding shell 5. The grommet 62 encloses the rear end portion of the second shield connector 4, the braided wire-connecting tube 54 and the exposed conductor 3*a* of the shielded wire 3. One end portion of the grommet 62 is fixedly secured to the shielding shell 5 by a ring-shaped fastening member 63, and the other end portion thereof is fixedly secured to the sheath 3*d* of the shielded wire 3 by a ring-shaped wire band 64. With this construction, the exposed conductor 3*a* of the shielded wire 3 is completely kept in a waterproof condition by the grommet 62.

Next, a method of producing the shield-type electric connector 1 will be described.

As shown in FIG. 2, the conductor 3*a'* and the signal wire 3*e'* of the wire 3', extending from the equipment, are passed through the mounting portion 13. The terminal 17 is secured to the signal wire 3*e'* by pressing (or by press-fitting). The terminal 17 is inserted into the terminal receiving chamber 16 in the first connector housing 11, and a shoulder 17*a* of the terminal 17 is engaged with the retaining lance 16*a* formed within the terminal receiving chamber 16. The conductor 3*a'* is inserted into the metal terminal receiving chamber 15 in the first connector housing 11, and then the first metal terminal 12 is secured to the conductor 3*a'* by pressing (or by press-fitting). The first metal terminal 12 is press-fitted into the metal terminal receiving chamber 15 from the connecting side (front side), and is fixed in this chamber. Thus, the first shield connector 2 is produced. At this time, preferably, a terminal retaining member 15*a* is inserted into the front end portion of the metal terminal receiving chamber 15 so as to prevent the displacement of the first metal terminal 12.

As shown in FIG. 3, the sheath is removed from the shielded wire 3, thereby exposing the braided wire 3*c*, and the shielded wire 3 is passed through a passage hole 62*a* in the grommet 62. The terminal 44 is secured to the signal wire 3*e* of the shielded wire 3 by pressing, and this terminal 44 is inserted into the terminal receiving chamber 35 in the second connector housing 31. The shoulder 44*a* of the terminal 44 is engaged with the retaining lance 35*a* within the terminal receiving chamber 35. The insulator 3*b* is removed from the shielded wire 3, thereby exposing the conductor 3*a*, and the second metal terminal is secured to the exposed conductor 3*a* by pressing. The second metal terminal 32 is inserted into the metal terminal receiving chamber 34 through the pressing tube-receiving chamber 38 in the second connector housing 31. The rear holder 33 is attached to the second connector housing 31 from the rear side thereof so as to prevent the rearward withdrawal of the second metal terminal 32. More specifically, when the terminal pressing tubes 46 of the rear holder 33 are received respectively in the pressing tube-receiving chambers 38 in the second connector housing 31, the engagement flange 42 is abutted against the engagement step portion 39 by the terminal pressing tube 46. As a result, the second metal terminal 32 is fixed in the metal terminal receiving chamber 34. Thus, the second shield connector 4 is produced. In this condition, the signal wire 3*e* is passed through the signal wire hole 46' in the rear holder 33.

Figure 6:
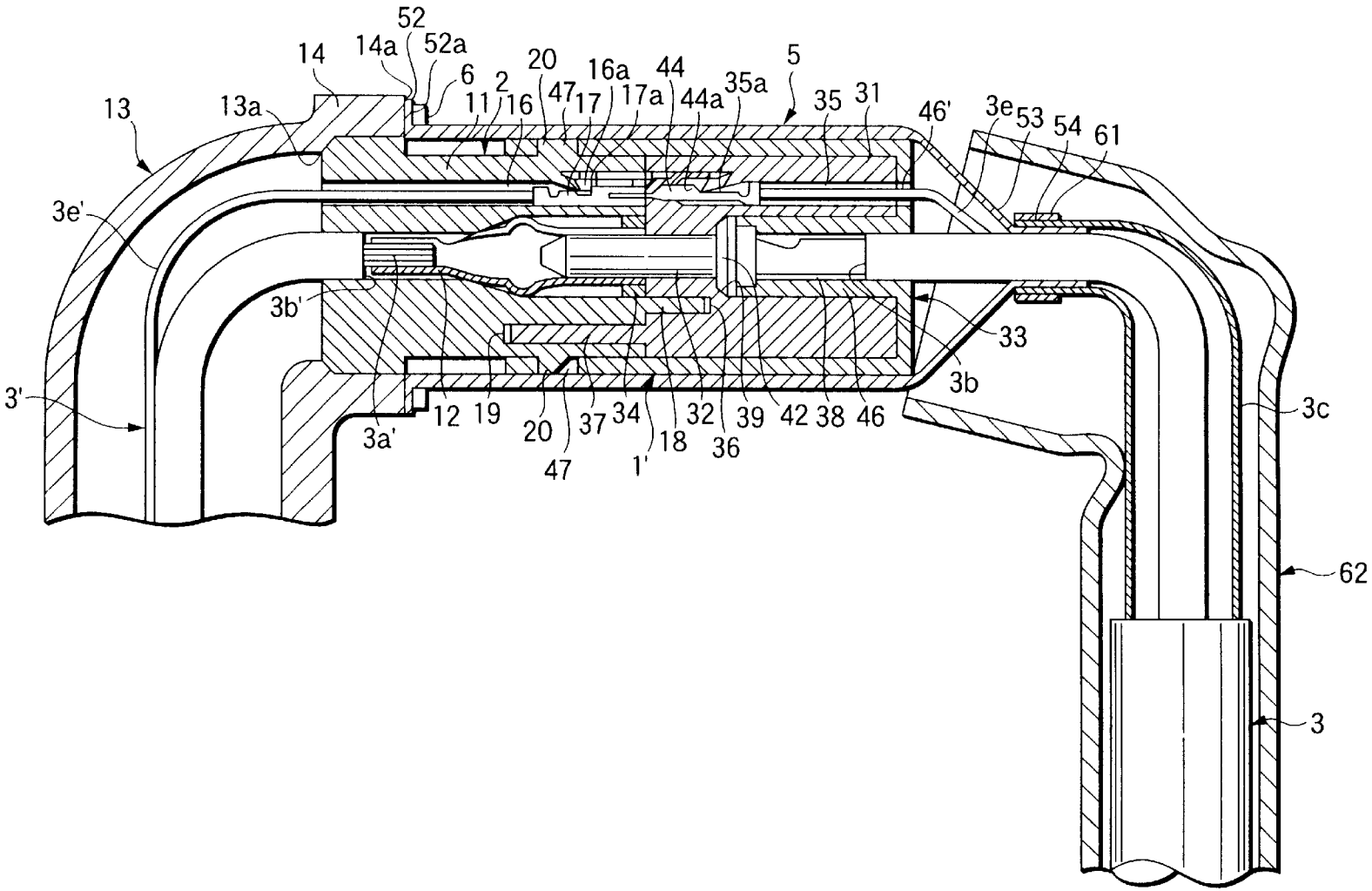
FIG. 6 is a view showing a condition in which the first shield connector, press-fitted into a mounting portion in a fixed manner, and the second shield connector are connected together by the rear holder, and subsequently the two shield connectors are fixed to the mounting portion by the shielding shell.
Figure 7:
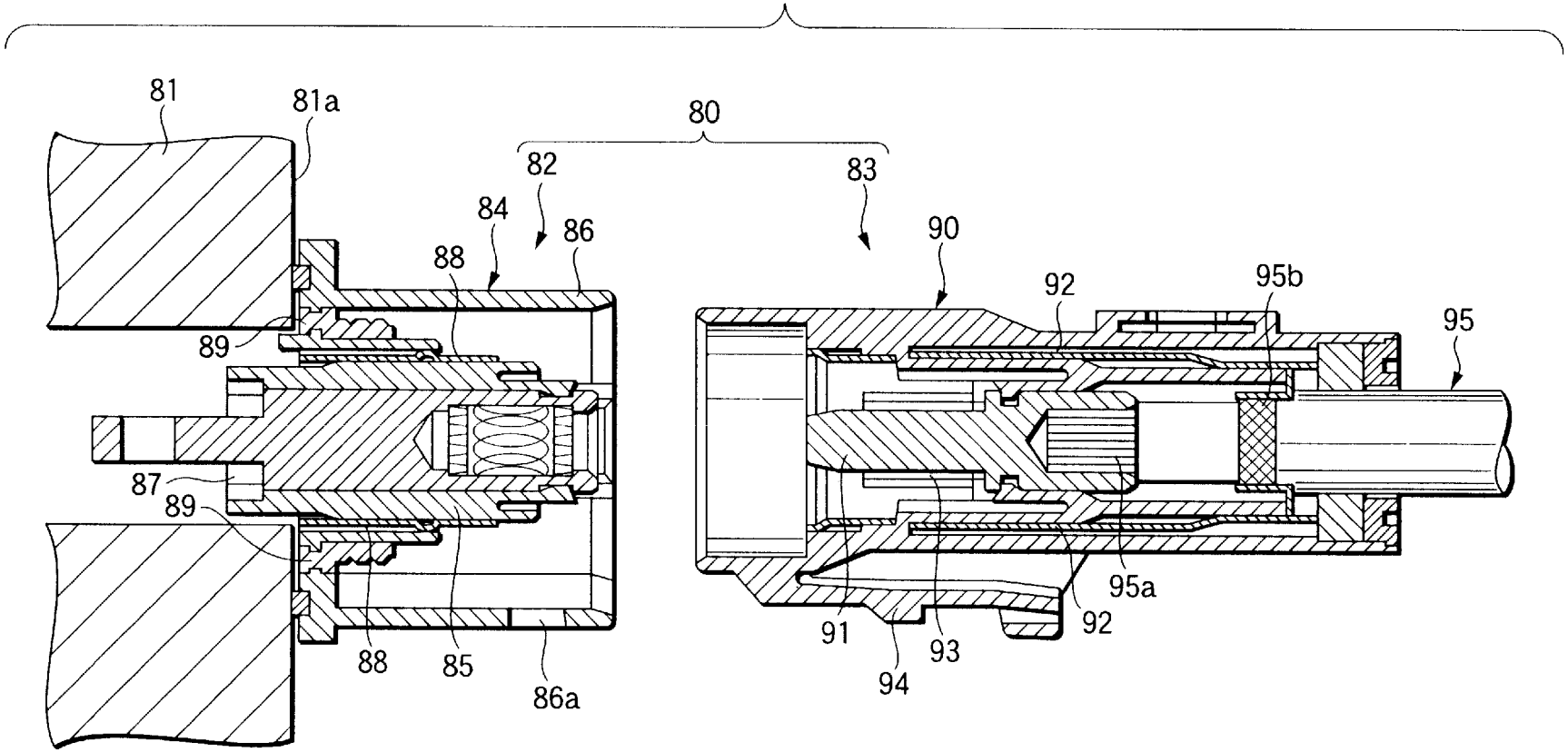
FIG.7 PRIOR ART
FIG. 7 is a view showing a related construction.

As shown in FIG. 6, the positioning pin 18 on the first connector housing 11 is aligned with the pin receiving hole 36 in the second connector housing 31 while the positioning pin 37 on the second connector housing 31 is aligned with the pin receiving hole 19 in the first connector housing 11. When the positioning pins 18 and 37 are inserted into the pin receiving holes 36 and 19, respectively, the front end surfaces 11*a* and 31*a* of the first and second connector housings 11 and 31 are abutted against each other. As a result, the terminal 17 in the first shield connector 2 is fitted on the terminal 44 in the second shield connector 4, and also the first metal terminal 12 is fitted on the second metal terminal 32. Almost simultaneously with this fitting operation, the projections 20 on the first connector housing 11 are engaged respectively in the engagement holes 47 in the rear holder 33. Thus, there is produced an electric connector member 1' in which the first and second shield connectors 2 and 4 are electrically and mechanically connected together.

The insulator 3*b* and the signal wire 3*e* of the shielded wire 3 are beforehand passed through the braided wire-connecting tube 54 of the shielding shell 5. The braided wire 3*c* of the shielded wire 3 is held between the braided wire-connecting tube 54 and the shielding tube 61, and the two tubes 54 and 61 are compressed by pressing or the like.

The rear end portion of the first connector housing 11 is press-fitted into the open end 13*a* of the mounting portion 13, thereby fixing the electric connector member 1' to this mounting portion. The shielding shell 5 is fitted onto the electric connector member 1' from the rear holder side. The mounting flange 52 of the shielding shell 5 is abutted against the engagement flange 14 of the mounting portion 13, and are fastened together by the bolts (or screws) 6 each passing through the fixing hole 52*a* into the fastening hole 14*a*.

The grommet 62, through which the shielded wire 3 is beforehand passed, is fitted on the shielding shell 5. The one end portion of the grommet 62 is fixed to the shielding shell by the fastening member 63, and the grommet is fixed to the sheath 3*d* of the shielded wire 3 by the wire band 64. Thus, the shield-type electric connector 1 is produced.

As shown in FIG. 1, the number of the component parts of the first and second shield connectors 2 and 4 is smaller as compared with the conventional construction, and therefore the number of electrical contact points, provided when connecting the two shield connectors together, is reduced. Therefore, the electrical contact resistance can be reduced, thereby enhancing the shielding effect.

Because of the reduced number of the component parts, the pressing force, required for connecting the first and second shield connectors 2 and 4 together, can be reduced.

The first and second shield connector housings 11 and 31 are fixed relative to each other by other means than a lock mechanism, and therefore the first connector housing 11 or/and the second connector housing 31 are prevented from damage.

And besides, there is no need to resin-mold those portions corresponding to the lock mechanism, and therefore molds for resin molding the first and second connector housings 11 and 31 can be simplified in configuration. Therefore, the production cost of the molds can be reduced.

In this embodiment, the rear holder (first rear holder) 33 is fitted on the second connector housing 31 to fix the second metal terminal 32. In a modified form of the present invention, similarly, a second rear holder (not shown) can be fitted on the first connector housing 11 to fix the first metal terminal 12. In this case, the first metal terminal 12 is inserted into the first connector housing 11 from the rear side thereof as described above for the second metal terminal 32. The second rear holder (not shown) may be retained on the first connector housing 11, or may be retained on the first rear holder 33.

As described above, in the present invention, the first and second shield connectors are simplified in construction, and therefore the number of the component parts can be reduced. Therefore, the number of electrical contact points, provided when connecting the first and second shield connectors together, is reduced, and therefore the electrical contact resistance is reduced. Therefore, the shielding effect of the shield-type electric connector can be enhanced as compared with the conventional construction.

The first and second connector housings are retained and fixed relative to each other by the rear holder, and therefore as compared with the conventional construction, the first and/or second connector housings are more effectively prevented from being damaged when connecting the two connector housings together. The first metal terminal is inserted into the first connector housing from the connecting side, and therefore a rear holder is not necessary, and the cost of the parts is reduced.

And besides, any means, similar to the conventional lock mechanism, does not need to be formed on the first and second connector housings by resin molding, and therefore the molds for molding the two connector housings can be simplified in construction. Therefore, the production cost of the molds is reduced.

Furthermore, since the first and second shield connectors are simplified in construction, the force, required for connecting the two shield connectors, can be reduced as compared with the conventional construction. Therefore, the connecting operation can be carried out easily.

In the present invention, the second rear holder covers the rear portion of the first connector housing, and therefore the first metal terminal, inserted in the first connector housing, is prevented from rearward withdrawal. Thus, the first and second metal terminals are positively prevented from rearward withdrawal by the respective rear holders.

In the present invention, the shielding shell of metal, covering the outer surfaces of the rear holder and the first connector housing, is directly fixed at one end thereof to the mounting portion of metal. Thus, the mounting portion and the shielding shell, both of which are made of metal, are fixedly connected to each other, and therefore damage (such as cracking) of the first and second connector housings is prevented in the fixing operation as compared with the fixing connection between a resin and metal or between a resin and a resin.

The other end of the shielding shell is fixedly connected to the braided wire of the shielded wire connected to the second metal terminal, and therefore the shielding effect of the shield-type electric connector is further enhanced.

In the present invention, after the one end of the shielding shell is fixedly secured to the mounting portion, the slanting wall, formed on the shielding shell intermediate the opposite ends thereof, urges that side of the rear holder, remote from the connecting side thereof, toward the connecting side thereof. Therefore, since the connected condition of the first and second connector housings can be positively maintained, the two connector housings are prevented from being disengaged from each other during the production of the shield-type electric connector. Therefore, the reliability of the connected condition is enhanced.

What is claimed is:

1. An equipment direct-mounting-type shield electric connector, comprising a pair of first and second shield connectors fittable to each other, wherein the first shield connector comprises:

a first connector housing, mounted directly on a mounting portion of an equipment, and a first metal terminal which is inserted into a metal terminal receiving chamber in the first connector housing, and is fixed in the chamber; and wherein the second shield connector comprises:

a second connector housing, abutted against the first connector housing, a second metal terminal, which is inserted into a metal terminal receiving chamber in the second connector housing from a side thereof remote from a connecting side thereof, and is electrically connected to the first metal terminal, and a rear holder which is inserted into the second connector housing from the side thereof remote from the connecting side thereof so as to prevent rearward withdrawal of the second metal terminal, and covers the outer surface of the second connector housing, and is retained on the outer surface of the first connector housing.

2. An equipment direct-mounting-type shield electric connector according to claim 1, wherein an outer surface of the rear holder and the outer surface of the first connector housing are covered with a shielding shell made of metal, and one end of the shielding shell is fixedly secured to the mounting portion made of metal, and another end of the shielding shell is fixedly connected to a braided wire of a shielded wire connected to the second metal terminal.

3. An equipment direct-mounting-type shield electric connector according to claim 2, wherein the one end of the shielding shell is fixedly secured to the mounting portion, and the shielding shell has a slanting wall formed intermediate opposite ends thereof, and the slanting wall urges a side of the rear holder, remote from the connecting side thereof, toward the connecting side thereof.

4. An equipment direct-mounting-type shield electric connector according to claim 1, wherein the first connector housing has projections which are respectively engaged in engagement holes of the rear holder.

5. An equipment direct-mounting-type shield electric connector, comprising a pair of first and second shield connectors fittable to each other, wherein the first shield connector comprises:

a first connector housing, mounted directly on a mounting portion of an equipment, and a first metal terminal which is inserted into a metal terminal receiving chamber in the first connector housing from a connecting side thereof, and is fixed in the chamber; and wherein the second shield connector comprises:

a second connector housing, abutted against the first connector housing, a second metal terminal, which is inserted into a metal terminal receiving chamber in the second connector housing from a side thereof remote from a connecting side thereof, and is electrically connected to the first metal terminal, and a rear holder which is inserted into the second connector housing from the side thereof remote from the connecting side thereof so as to prevent rearward withdrawal of the second metal terminal, and covers an outer surface of the second connector housing, and is retained on an outer surface of the first connector housing, wherein an outer surface of the rear holder and the outer surface of the first connector housing are covered with a shielding shell made of metal, and one end of the shielding shell is fixedly secured to the mounting portion made of metal, and another end of the shielding shell is fixedly connected to a braided wire of a shielded wire connected to the second metal terminal, and wherein the shielding shell has a slanting wall formed intermediate opposite ends thereof, and the slanting wall urges a side of the rear holder, remote from the connecting side thereof, toward the connecting side thereof.

6. An equipment direct-mounting-type shield electric connector, comprising a pair of first and second shield connectors fittable to each other, wherein the first shield connector comprises:

a first connector housing, mounted directly on a mounting portion of an equipment, and a first metal terminal which is inserted into a metal terminal receiving chamber in the first connector housing, and is fixed in the chamber; and wherein the second shield connector comprises:

a second connector housing, abutted against the first connector housing, a second metal terminal, which is inserted into a metal terminal receiving chamber in the second connector housing from a side thereof remote from a connecting side thereof, and is electrically connected to the first metal terminal, and a rear holder which is inserted into the second connector housing from the side thereof remote from the connecting side thereof so as to prevent rearward withdrawal of the second metal terminal, and covers an outer surface of the second connector housing, and is retained on an outer surface of the first connector housing, and wherein an outer surface of the rear holder and the outer surface of the first connector housing are covered with a shielding shell made of metal, and one end of the shielding shell is fixedly secured to the mounting portion made of metal, and another end of the shielding shell is fixedly connected to a braided wire of a shielded wire connected to the second metal terminal, and wherein the one end of the shielding shell is fixedly secured to the mounting portion, and the shielding shell has a slanting wall formed intermediate opposite ends thereof, and the slanting wall urges a side of the rear holder, remote from the connecting side thereof, toward the connecting side thereof.

* * * * *